US005638840A

United States Patent [19]

Lee et al.

[11] Patent Number: 5,638,840

[45] Date of Patent: Jun. 17, 1997

[54] COMBINATION TOOTHPASTE DISPENSER, TOOTHBRUSH HOLDER, DRINKING CUP AND FLOSS DISPENSER, FORMING A UNITARY STRUCTURE SIMULATIVE OF A CAT

[76] Inventors: Inita Lee, 138 Westgate Cir., Santa Rosa, Calif. 95401-5831; Kenneth Tarlow, 94 Birch Ave., Corte Madera, Calif. 94925

[21] Appl. No.: 537,353

[22] Filed: Oct. 3, 1995

[51] Int. Cl.[6] ..... A45D 44/18; A61C 15/00

[52] U.S. Cl. ..... 132/310; D3/205; 132/325; D4/108; D6/531

[58] Field of Search ..... 132/308, 309, 132/310, 324, 325; D3/205; D4/107, 108, 125; D6/528, 531, 534; D28/64

[56] References Cited

U.S. PATENT DOCUMENTS

| | | | |
|---|---|---|---|
| D. 345,824 | 4/1994 | Fitz | D6/528 |
| D. 365,684 | 1/1996 | Loomis et al. | D4/108 |
| D. 366,794 | 2/1996 | Lee | D6/528 |
| 3,894,550 | 7/1975 | Eaton | 132/310 |
| 4,121,600 | 10/1978 | Riddick et al. | 132/310 |
| 5,215,193 | 6/1993 | Dennis | 132/310 |

FOREIGN PATENT DOCUMENTS

| | | | |
|---|---|---|---|
| 965652 | 9/1950 | France | 132/308 |
| 116946 | 8/1946 | Sweden | 132/310 |

*Primary Examiner*—Todd E. Manahan

[57] ABSTRACT

A combination toothbrush holder, floss dispenser, drinking cup and toothpaste holder designed to compactly hold and dispense the above items while maintaining a unified appearance in the shape of a sitting cat. The head portion contains a standard dental floss container. The floss protrudes through a hole in the cat shaped head. A cutting blade is affixed to the top of the cat shaped head for cutting the floss. The midsection of the cat shape forms a drinking cup and also forms an enclosure for a standard toothpaste tube. The base section of the cat shape contains a pair of mating rollers capable of squeezing a tube of toothpaste captured between the two rollers. This happens when the user rotates the tail portion of the cat shape which is rigidly connected to the shaft of one of the rollers. The outside portion of the base contains receptacles for a plurality of toothbrushes. In this way, the present invention holds and dispenses all the items necessary for caring for the teeth and gums and does so in a compact and novel fashion which will entice the user the use the dental care items contained therein.

1 Claim, 5 Drawing Sheets

COMBINATION TOOTHPASTE DISPENSER, TOOTHBRUSH HOLDER, DRINKING CUP AND FLOSS DISPENSER, FORMING A UNITARY STRUCTURE SIMULATIVE OF A CAT

BACKGROUND OF THE INVENTION

It is known to have a combination of a toothpaste dispenser, toothbrush holder, drinking cup and floss dispenser.

The present invention is directed toward a novel combination of the above elements so that when in a nonuse position the combined elements form a figure in the shape of a cat.

SUMMARY OF THE INVENTION

The present invention is directed to a unified enclosure creating a combination toothpaste dispenser, toothbrush holder, drinking cup and floss dispenser which in its nonuse position forms the shape of a cat. An object of the present invention is to provide a unified enclosure for the above items which can sit on the counter top of a bathroom sink area and take up a minimum of space. A further object of the present invention is to provide a unified enclosure which neatly stores and dispenses all the items needed for normal dental health care. It is a further object of the present invention to provide a unified enclosure which is easy to manufacture and economical to produce.

Accordingly, the main object of this invention is a device which holds and dispenses all the items necessary to good dental care in a unified enclosure which forms the shape of a sitting cat. The cat body is divided into three major hollow sections. The head section contains a means for holding and dispensing dental floss. The mid section serves as a drinking cup and as an enclosure for toothpaste. The lower section contains a toothpaste dispensing mechanism which squeezes toothpaste out of a conventional toothpaste tube by means of a pair of rollers which are caused to turn by the user turning the cats tail. The lower portion also contains receptacles for holding a plurality of toothbrushes.

DESCRIPTION OF THE PREFERRED EMBODIMENT

Figure 1:
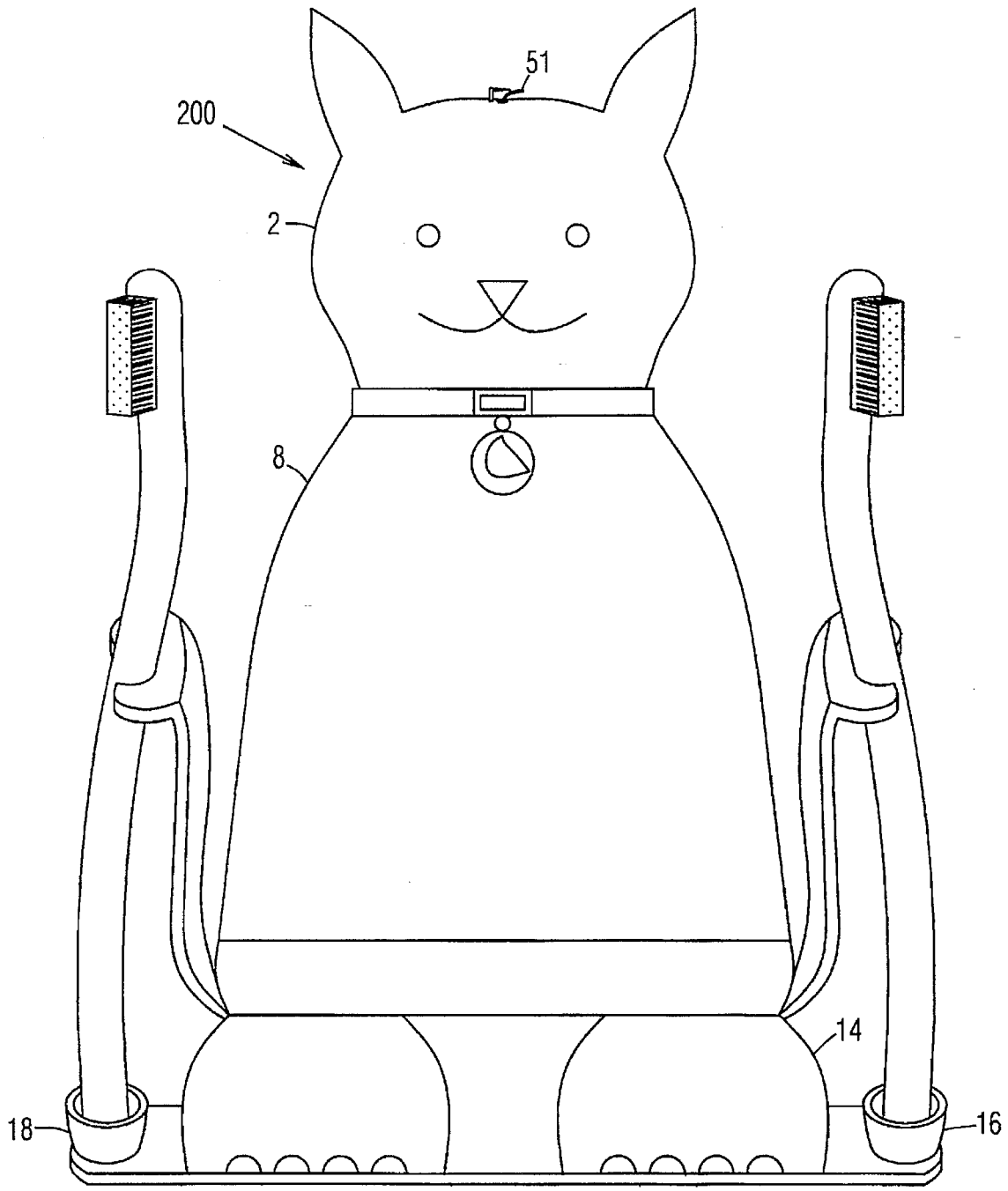
FIG. 1 shows a front view of the present invention.
Figure 2:
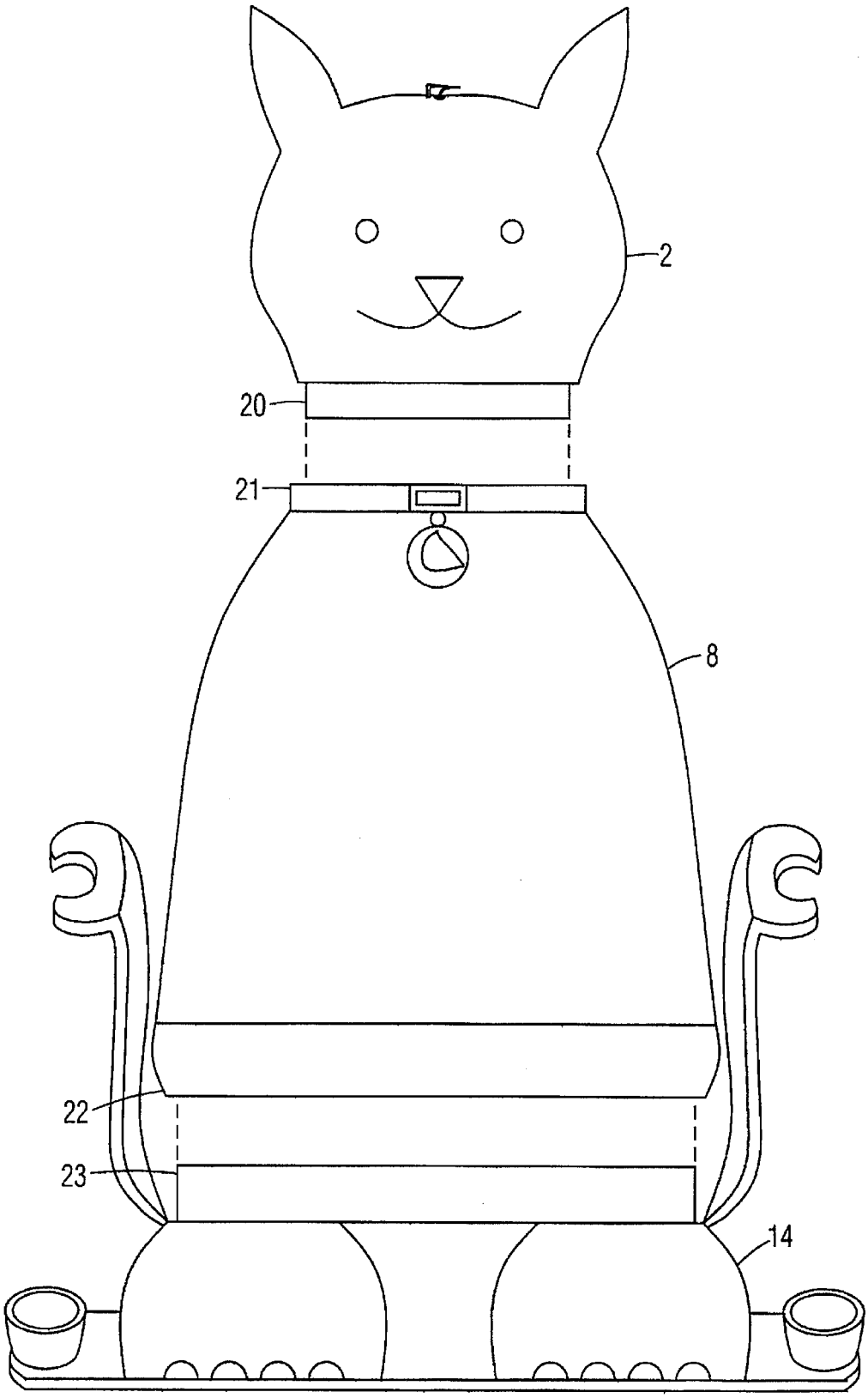
FIG. 2 shows a front view of the present invention where the three major sections are separated
Figure 3:
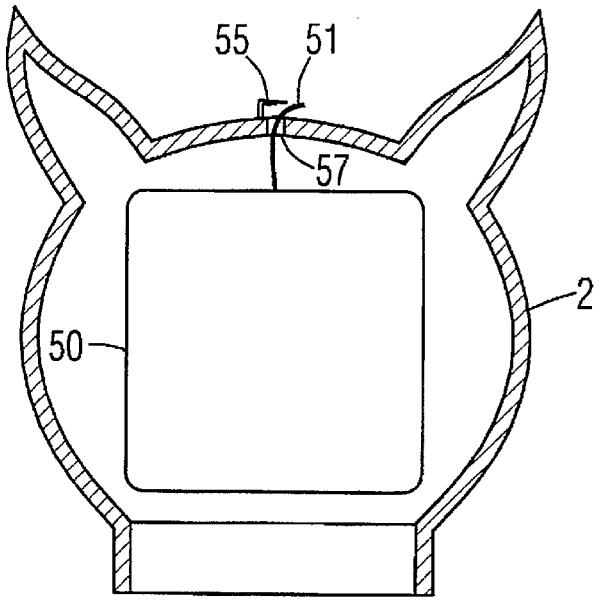
FIG. 3 is a front section view of the head portion of the present invention.

Referring now to FIG. 1 the overall container 200 is in the shape of a cat. Head 2 acts as a dental floss holder and dispenser. Floss 51 protrudes from the cats head 2. Mid section 8 acts as a drinking cup. Base section 14 acts as a toothbrush holder 16,18 and also acts as a toothpaste holder and dispenser as will be explained below. FIG. 2 shows how the head 2 midsection 8 and base 14 are connected to each other by telescoping cylindrical rings formed at the neck area 20,21 and the base area 22,23. FIG. 3 is a section view of the head portion 2. Floss and floss container 50 are commonly available where dental care supplies are sold.

Figure 4:
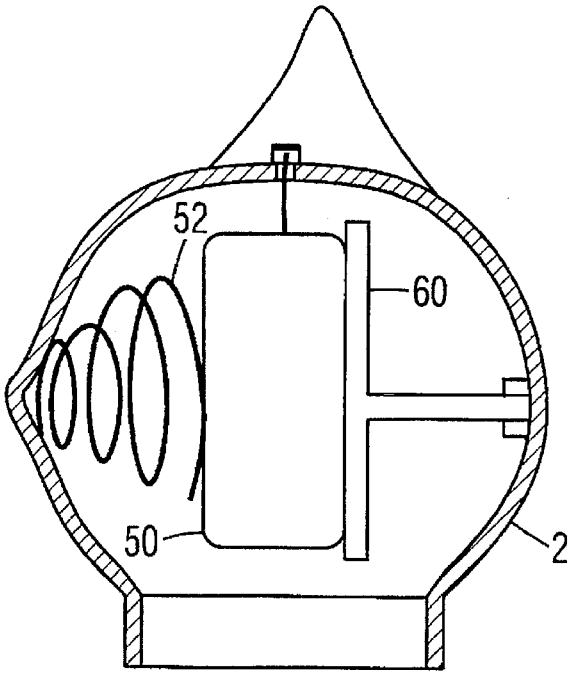
FIG. 4 shows a side section view of the head portion of the present invention.
Figure 5:
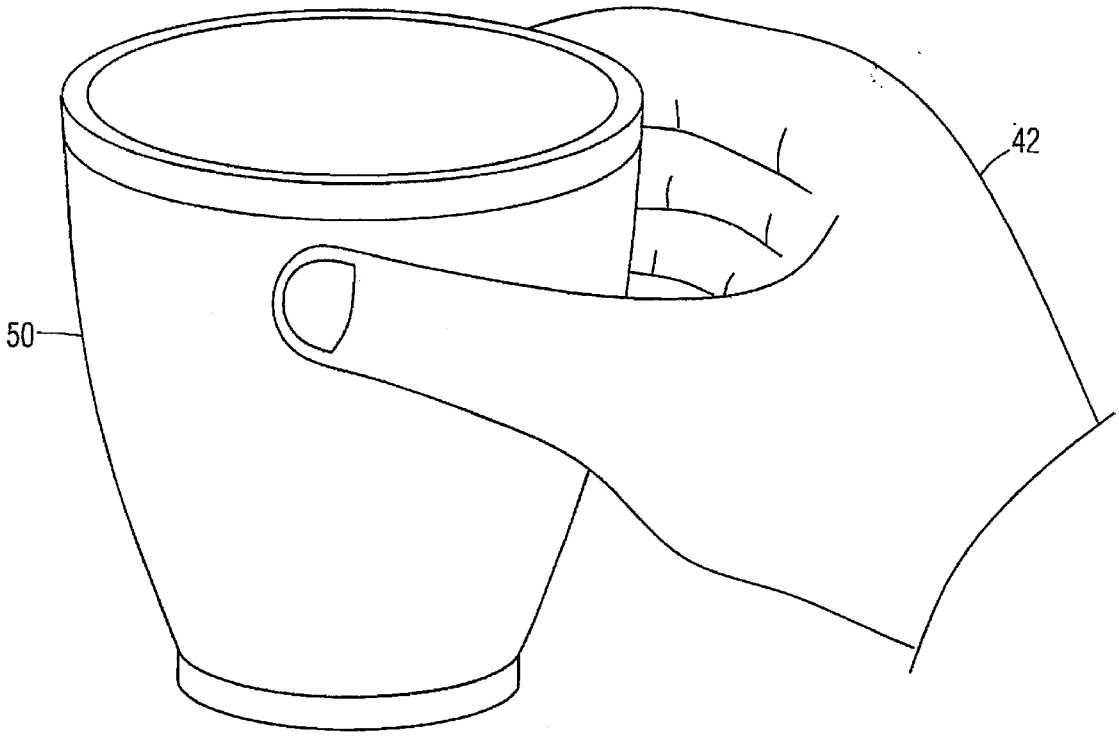
FIG. 5 shows a perspective view of the mid portion or the present invention.
Figure 6:
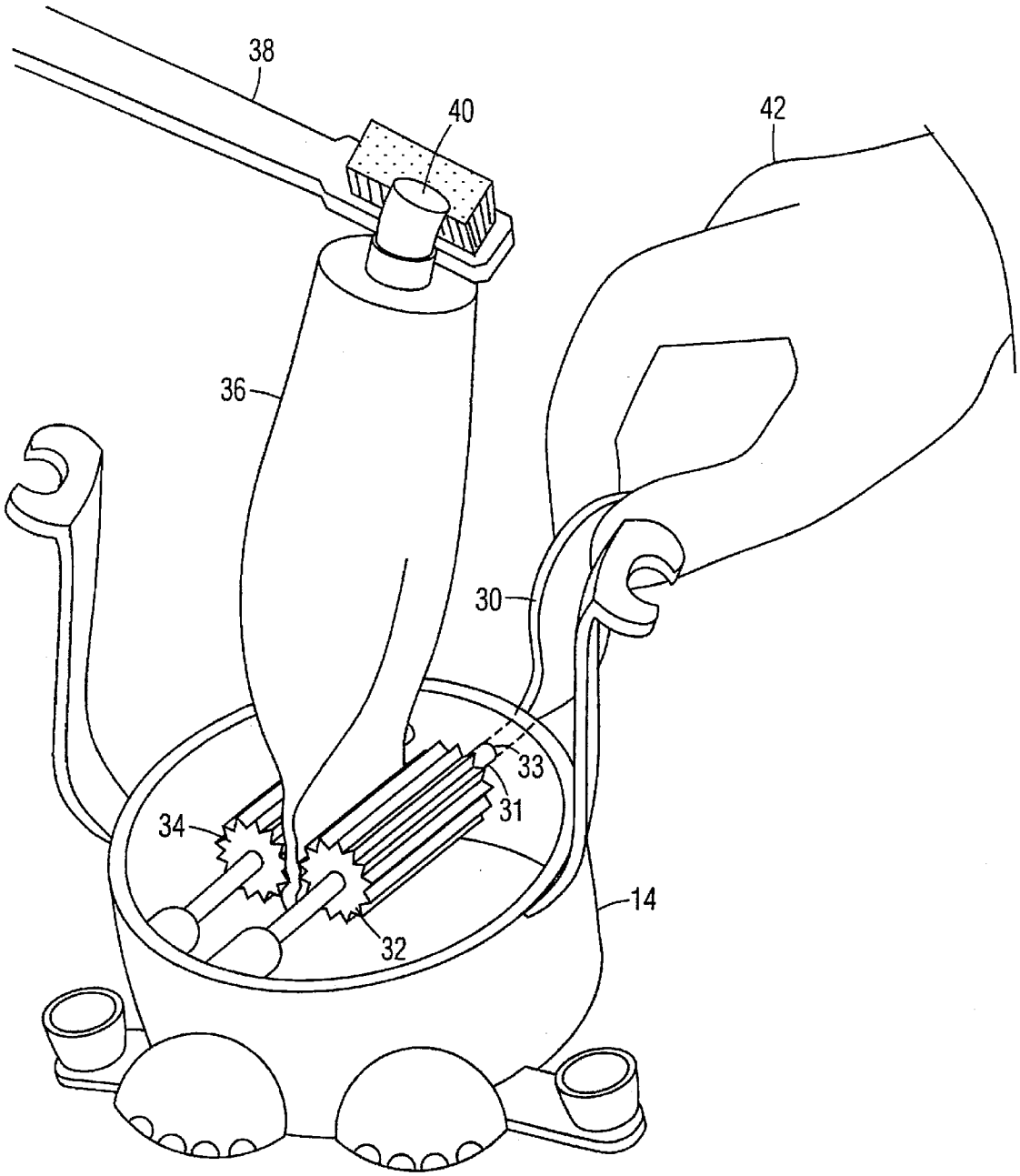
FIG. 6 shows a perspective view of the base section of the present invention.

Floss 51 extends up through a hole 57 in the cats head 2. Cutting blade 55 cuts the floss 51 to the desired length. FIG. 4 shows a side section of the head portion of the present invention wherein compression spring 52 acts to hold floss container 50 against back plate 60. Floss 50 may be removed and replaced when necessary. FIG. 5 shows a perspective view of the midsection 50 when held by a persons hand 42 in an inverted position becomes a drinking cup for the purpose of rinsing ones mouth after brushing ones teeth. FIG. 6 shows a perspective view of the base 14 of the present invention with the midsection 8 removed. The inner hollow portion of the base section 14 contain a pair of rotatable mating rollers 32,34. One of the rollers 32 has a permanently attached shaft 31 which exits through a hole 33 at the rear of base portion 14. A tail shaped member is permanently attached to shaft 33 . The tail acts as a handle for turning the mating rollers 32,34. The bottom end of standard toothpaste tube 36 is fed by the user into mating rollers 32,34 and when handle 30 is turned by the users hand 42 the toothpaste tube 36 is squeezed causing toothpaste 40 to be dispensed and capable of being applied to toothbrush 38

While the present invention has been described in connection with what is considered the most practical and preferred embodiment, it is understood that this invention is not limited to the disclosed embodiment but is intended to cover various arrangements included within the spirit and scope of the broadest interpretation so as to encompass all such modifications and equivalent arrangements.

We claim:

1. A combination toothpaste dispenser, toothbrush holder, drinking cup and floss dispenser forming a unitary structure simulative of a cat comprising:

an upper section comprising a hollow housing having a top and a bottom; a back plate vertically disposed within said housing; a compression spring contained within said housing opposite said back plate; a dental floss container received within said housing and disposed between said back plate and said compression spring; a floss dispensing opening formed in the top of said housing; and a floss cutting member located on the top of said housing adjacent said opening, said upper section being simulative of a head of the cat;

a middle section comprising a substantially cylindrical container having an open bottom and a closed top such that when inverted, said container may be used as a drinking cup, said middle section being simulative of a body of the cat; and a base section comprising a base having an upstanding sidewall forming an enclosure and a plurality of depressions formed in said base and disposed outside said enclosure for holding toothbrushes, said base section being simulative of legs and feet of the cat; a pair of mating, elongate, parallel rollers disposed within said enclosure, one of said rollers having a shaft extending therefrom such that a free end of said shaft projects through the sidewall of the base exteriorly of the housing; and a handle attached to the free end of the shaft, said handle being simulative of a tail of the cat; whereby a tube of toothpaste may be disposed between said mating, elongate rollers such that when said handle is turned, said mating, elongate rollers are caused to rotate, thereby squeezing the tube of toothpaste to dispense toothpaste therefrom;

means formed on the open bottom of said middle section and on the enclosure of said base for removably securing said middle section to said base; and means formed on the bottom of said upper section and on the closed top of said middle section for removably securing said upper section to said middle section.

* * * * *